US011421467B2

(12) United States Patent
Kawaguchi

(10) Patent No.: US 11,421,467 B2
(45) Date of Patent: Aug. 23, 2022

(54) OPENING-CLOSING BODY CONTROLLER

(71) Applicant: DENSO CORPORATION, Kariya (JP)

(72) Inventor: Tomohiko Kawaguchi, Kariya (JP)

(73) Assignee: DENSO CORPORATION, Kariya (JP)

( * ) Notice: Subject to any disclaimer, the term of this patent is extended or adjusted under 35 U.S.C. 154(b) by 225 days.

(21) Appl. No.: 16/749,288

(22) Filed: Jan. 22, 2020

(65) Prior Publication Data

US 2020/0240196 A1 Jul. 30, 2020

(30) Foreign Application Priority Data

Jan. 25, 2019 (JP) ..... JP2019-011407

(51) Int. Cl.
*E05F 15/695* (2015.01)
*E05F 15/41* (2015.01)

(52) U.S. Cl.
CPC ..... *E05F 15/695* (2015.01); *E05F 15/41* (2015.01); *E05Y 2400/31* (2013.01); *E05Y 2400/554* (2013.01); *E05Y 2400/58* (2013.01); *E05Y 2900/55* (2013.01)

(58) Field of Classification Search
None
See application file for complete search history.

(56) References Cited

U.S. PATENT DOCUMENTS 5,351,439 A * 10/1994 Takeda ..... G01L 5/0042 49/28
10,814,702 B2 * 10/2020 Aoki ..... E05F 15/689
2004/0124801 A1 * 7/2004 Jurado ..... G05B 13/0265 318/476
2006/0208676 A1 * 9/2006 Adachi ..... E05F 15/41 318/256
2009/0138161 A1 * 5/2009 Wagner ..... E05F 15/695 701/49
2009/0293361 A1 * 12/2009 Heckmann ..... E05F 15/41 49/31
2014/0121907 A1 * 5/2014 Whinnery ..... G06F 17/00 701/49
2014/0239867 A1 * 8/2014 Bessho ..... E05F 15/41 318/466
2016/0077528 A1 * 3/2016 Scholz ..... E05F 15/695 701/49

(Continued)

FOREIGN PATENT DOCUMENTS

JP 06137029 A * 5/1994
JP H06-327279 A 11/1994
JP 07269226 A * 10/1995

(Continued)

*Primary Examiner* — Marcus Menezes
(74) *Attorney, Agent, or Firm* — Oliff PLC

(57) ABSTRACT

An opening-closing body controller includes a motor body that opens and closes an open-close body, a control unit that controls and drives the motor body, and an inner temperature detector that detects an inner temperature of the motor body. The control unit performs an entrapment detection process in a section excluding a mask section that is set from a fully closed position of the open-close body to a preset position in an opening direction of the open-close body. The control unit corrects the mask section in accordance with the inner temperature of the motor body detected by the inner temperature detector.

3 Claims, 4 Drawing Sheets

(56) References Cited

U.S. PATENT DOCUMENTS

| | | | | |
|---|---|---|---|---|
| 2017/0012566 | A1* | 1/2017 | Katsura | E05F 15/659 |
| 2018/0298671 | A1* | 10/2018 | Roppongi | E05F 15/79 |

FOREIGN PATENT DOCUMENTS

| | | | | | |
|---|---|---|---|---|---|
| JP | H07-269226 | A | | 10/1995 | |
| JP | H10-262385 | A | | 9/1998 | |
| JP | 2008-150830 | A | | 7/2008 | |
| JP | 2014-34831 | A | | 2/2014 | |
| JP | 2015-124489 | A | | 7/2015 | |
| JP | 2017-210750 | A | | 11/2017 | |
| JP | 2017210750 | A | * | 11/2017 | B60J 1/00 |

* cited by examiner

OPENING-CLOSING BODY CONTROLLER

BACKGROUND

1. Field

The following description relates to an opening-closing body controller.

2. Description of Related Art

One example of an opening-closing body controller installed in a vehicle is a power window device (refer to, for example, Japanese Laid-Open Patent Publication No. 2014-34831). There is a power window device that functions to prevent a foreign object from being entrapped by a window glass during a closing action. Such a power window device performs an entrapment detection process that detects a foreign object hampering the action of the window glass from changes in the rotation speed of a motor, which serves as a drive source, and stops or reverses the motor upon detection of such a foreign object to reduce the load acting on the foreign object.

The power window device uses a position where the rotation of the motor is arrested during a closing action (mechanical lock position) as a reference position (fully closed position) so that the power window device does not perform the entrapment detection process in a section from the reference position to a preset position in an opening direction.

The opening-closing body controller uses the fully closed position as the reference position and does not perform the entrapment detection process in a mask section set from the reference position to the preset position in the opening direction. However, the reference position may be shifted by changes in the arresting torque of the motor, which moves an open-close body, resulting from the ambient temperature. This may change the mask section and cause inappropriate entrapment detection, that is, erroneous detection.

SUMMARY

It is an objective of the present description to provide an opening-closing body controller that reduces erroneous entrapment detection resulting from ambient temperature.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an opening-closing body controller includes a motor body that opens and closes an open-close body, a control unit that controls and drives the motor body, and an inner temperature detector that detects an inner temperature of the motor body. The control unit performs an entrapment detection process in a section excluding a mask section (A1) that is set from a fully closed position of the open-close body to a preset position in an opening direction of the open-close body. The control unit is configured to correct the mask section in accordance with the inner temperature of the motor body detected by the inner temperature detector.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and-or systems described. Modifications and equivalents of the methods, apparatuses, and-or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An opening-closing body controller 10 according to one embodiment will now be described with reference to the drawings.

Figure 1:
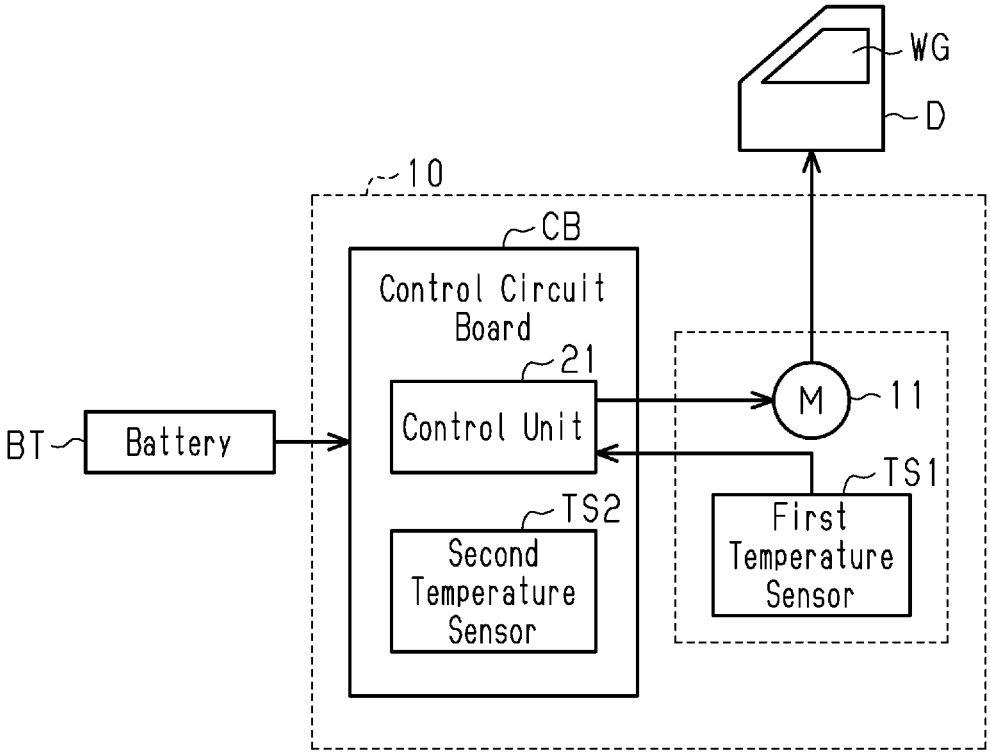
FIG. 1 is a schematic configuration diagram showing a system that includes an opening-closing body controller according to one embodiment.

As shown in FIG. 1, the opening-closing body controller 10 includes a motor body 11 and a control unit 21.

The motor body 11 is a power window motor installed in a vehicle door D to automatically open and close a window glass WG, which serves as an open-close body arranged in the vehicle door D.

Figure 2:
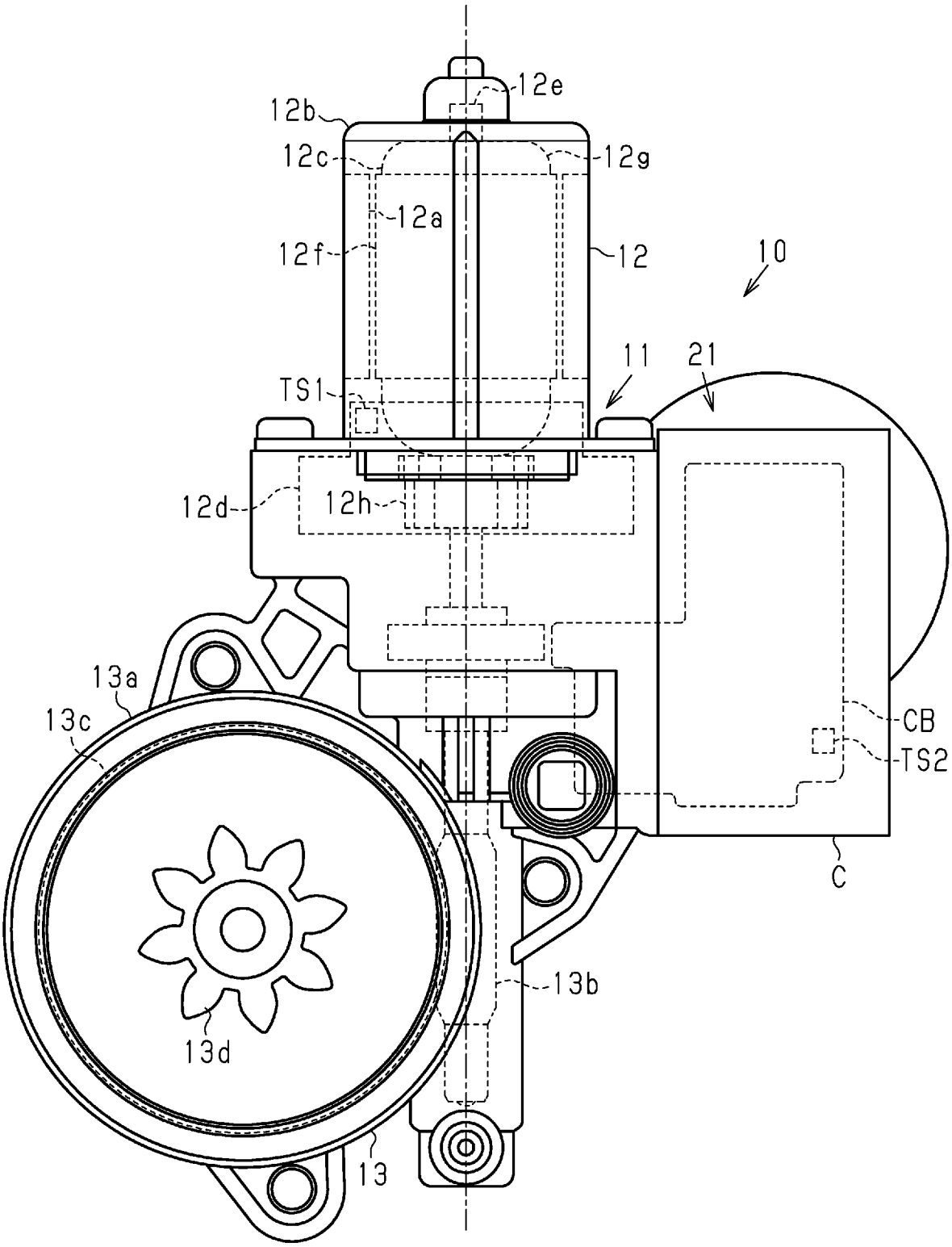
FIG. 2 is a schematic configuration diagram showing the opening-closing body controller of the embodiment that includes a motor body.

As shown in FIG. 2, the motor body 11 includes a motor unit 12 and a speed reducing unit 13.

The motor unit 12 includes a tubular yoke 12*b* having a closed end, a magnet 12*a* fixed on the inner surface of the yoke 12*b*, an armature 12*c* accommodated in the yoke 12*b*, and a brush holder 12*d* (not shown) arranged at the open part of the yoke 12*b*.

The speed reducing unit 13 includes a gear housing 13*a* that is fixed to the open part of the yoke 12*b*, a worm 13*b* that is accommodated in the gear housing 13*a* and rotated integrally with a rotary shaft 12*e* of the armature 12*c*, a worm wheel 13*c* that is accommodated in the gear housing 13*a* and meshed with the worm 13*b*, and an output shaft 13*d* that is rotated integrally with the worm wheel 13*c*.

The armature 12*c* includes the rotary shaft 12*e*, an armature core 12*g* fitted onto and fixed to the rotary shaft 12*e* and having a winding 12*f* wound about the armature core 12*g*, and a commutator 12*h* fitted onto and fixed to the rotary shaft 12*e*.

As shown in FIG. 2, the brush holder 12*d* holds a power supply brush that supplies power to the armature 12*c* (specifically, to winding 12*f* via commutator 12*h*). Further, the brush holder 12*d* of the present example includes a first temperature sensor TS1 that serves as an inner temperature sensor that detects the temperature inside the motor body 11. The first temperature sensor TS1 outputs information of the detected temperature inside the motor body 11 to the control unit 21. The control unit 21 may be circuitry including: 1) one or more processors that execute various processes according to a computer program (software); 2) one or more dedicated hardware circuits (application specific integrated circuits: ASIC) that execute at least part of various processes; or 3) a combination thereof. The processor includes a CPU and memories such as a RAM and a ROM. The memories store program codes or commands configured to have the CPU execute processes. The memories, or computer readable media, include any type of medium accessible by versatile or dedicated computers.

As shown in FIG. 1, the control unit 21 of the opening-closing body controller 10 controls the rotation and driving of the motor body 11 via a drive circuit (not shown) including a relay or the like that is supplied with power from a vehicle battery BT in accordance with an operation of an opening and closing switch arranged on the vehicle door D. The rotation and driving of the motor body 11 is transmitted to the window glass WG via a window regulator (not shown) to open and close the window glass WG in the up-down direction.

As shown in FIG. 2, the control unit 21 is arranged on a control circuit board CB inside a board case C attached integrally to the gear housing 13*a*. The control circuit board CB includes various types of electronic components and controls driving of the motor body 11. The control circuit board CB in the present example also includes a second temperature sensor TS2 that serves as a board temperature sensor. The second temperature sensor TS2 detects the temperature around the control circuit board CB and outputs information of the detected temperature to the control unit 21 as outside temperature.

The control unit 21 detects the rotational position of the motor body 11, that is, the position of the window glass WG from a rotation pulse signal that is synchronized with the rotation of the motor body 11, specifically, from the count of pulse signal edges. The positional information of the window glass WG is stored in a memory (not shown) whenever detected.

The control unit 21 adjusts the voltage supplied from battery BT through PWM control and adjusts the voltage applied to the motor body 11 to execute speed control on the motor body 11. This adjusts the moving speed of the window glass WG during opening and closing actions.

The control unit 21 determines whether a foreign object is entrapped by the closing window glass WG from driving information (e.g., rotation speed, current value, or the like) of the motor body 11. When entrapment occurs, the control unit 21 performs an entrapment detection process that drive-controls the motor body 11 to stop or reverse the window glass WG.

During a closing action (upward movement) of the window glass WG, when the window glass WG reaches the fully closed position (mechanical lock position at end of movable region) and the rotation of the motor body 11 is arrested, the control unit 21 detects a lock current resulting from the arrest and stops the supply of power to the motor body 11.

Figure 3:
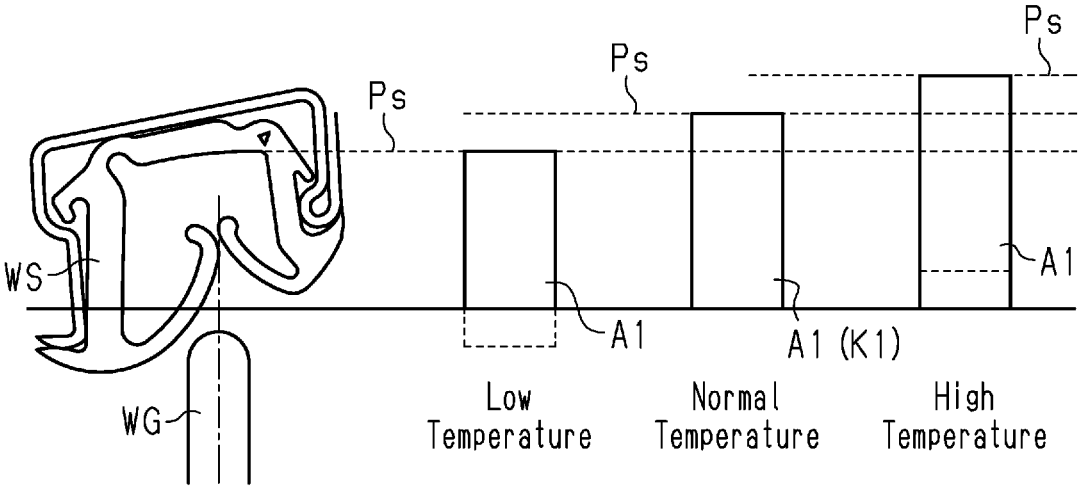
FIG. 3 is a diagram illustrating correction of a mask section in the embodiment.

As shown in FIG. 3, the control unit 21 recognizes the position where the rotation of the motor body 11 has been arrested (position where lock current is detected) as reference position Ps (fully closed position). The control unit 21 recognizes the count number of the pulse signals from a rotation detection sensor as positional information of the window glass WG. The control unit 21 adds the count number, which corresponds to the pulse signals from the rotation detection sensor, to reference position Ps during movement of the window glass WG in the opening direction.

The control unit 21 sets mask section A1 in which the entrapment detection process is not performed to a section from reference position Ps to a preset position in the opening direction (downward). The control unit 21 performs the entrapment detection process outside mask section A1 (in entrapment detection process section A2).

The control unit 21 corrects the length of mask section A1 in accordance with the temperature detected by the first temperature sensor TS1 and the second temperature sensor TS2. Specifically, at a low temperature that is lower than a normal temperature, the control unit 21 performs a subtraction to narrow mask section A1 from reference section K1 that is set in correspondence with the normal temperature. Specifically, the control unit 21 subtracts a predetermined section from reference section K1. At a high temperature that is higher than the normal temperature, the control unit 21 performs an addition to enlarge mask section A1 from reference section K1. Specifically, the control unit 21 adds a predetermined section to reference section K1. The control unit 21 corrects mask section A1 in this manner.

The operation of the present embodiment will now be described.

Figure 4:
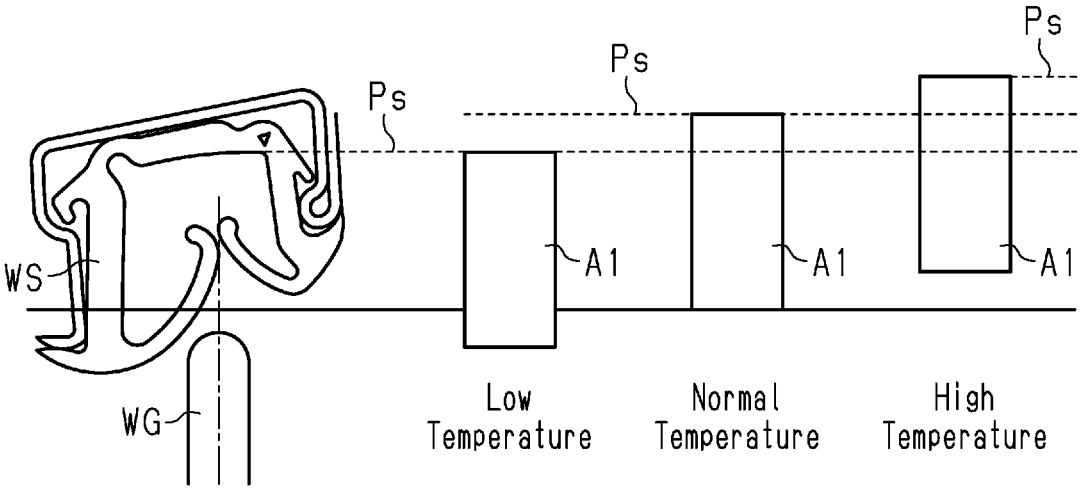
FIG. 4 is a diagram illustrating correction of a mask section in a referential example.

As shown in FIGS. 3 and 4, reference position Ps changes in accordance with the ambient temperature. Specifically, a change in temperature will vary the sliding resistance between the window glass WG and a weather strip WS and the arresting torque of the motor body 11. Thus, at a low temperature, reference position Ps will be moved downward (opening direction) from a normal temperature. At a high temperature, reference position Ps will be moved upward (closing direction) from the normal temperature. In a referential example shown in FIG. 4, mask section A1 is fixed regardless of changes in the temperature. If reference position Ps is moved, mask section A1 is shifted in the opening direction of the window glass WG at a low temperature. This narrows the section where entrapment of a foreign object is detected and may cause erroneous entrapment detection. Likewise, mask section A1 is shifted in the closing direction of the window glass WG at a high temperature. This widens the section where entrapment of a foreign object is detected and may cause erroneous entrapment detection even during a normal action.

Accordingly, when, for example, the window glass WG is closed in a low temperature environment, a subtraction correction in the opening direction is performed on mask section A1 so that mask section A1 becomes narrower than reference section K1, which is set in correspondence with the normal temperature. This avoids narrowing of the section in which entrapment of a foreign object is detected. Further, when the window glass WG is closed in a high temperature environment, an addition correction in the opening direction is performed on mask section A1 so that mask section A1 becomes wider than reference section K1. This avoids widening of the section in which entrapment of a foreign object is detected. The position of mask section A1 toward the opening direction resulting from each correction may be the same.

The present embodiment has the following advantages.

(1) Mask section A1 is corrected in accordance with the inner temperature of the motor body 11 detected by the first temperature sensor TS1, which serves as an inner temperature detector. This reduces erroneous entrapment detection resulting from a change in the inner temperature of the motor body 11, which is an ambient temperature.

(2) Mask section A1 is appropriately corrected by performing a subtraction so that mask section A1 becomes narrower than reference section K1 at a low temperature that is lower than a normal temperature and by performing an addition so that mask section A1 becomes wider than reference section K1 at a high temperature that is higher than the normal temperature. This reduces erroneous entrapment detection resulting from a change in the ambient temperature.

(3) Mask section A1 is corrected in accordance with the outside temperature. This reduces erroneous entrapment detection resulting from changes in temperature.

(4) The second temperature sensor TS2, which serves as a board temperature sensor and detects the temperature around the control circuit board CB, is arranged on the control circuit board CB, which is arranged integrally with the motor body 11. This allows the same opening-closing body controller 10 to measure both of the outside temperature and the inner temperature. Thus, there is no need to obtain the outside temperature from the outside.

The above-described embodiments may be modified as follows. The above-described embodiments and the following modifications can be combined as long as the combined modifications remain technically consistent with each other.

Figure 5:
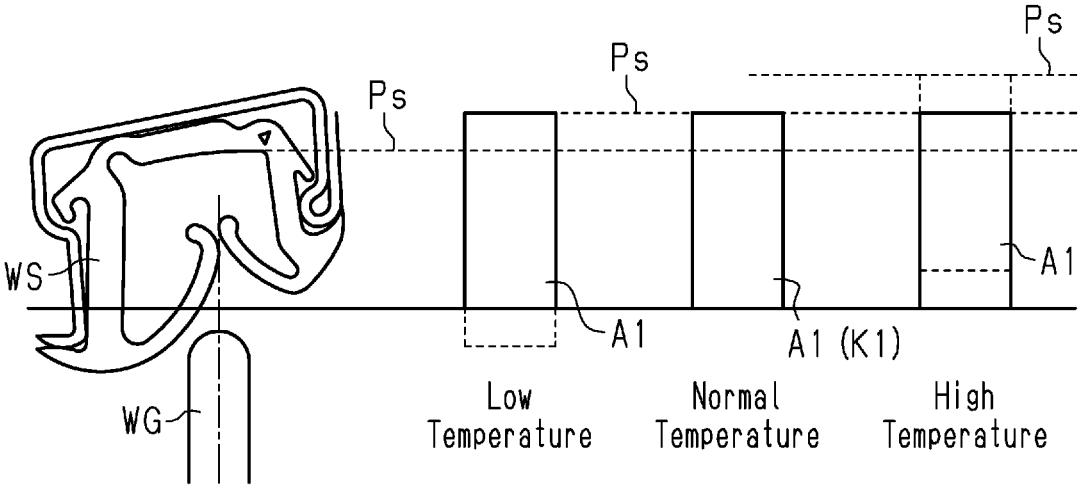
FIG. 5 is a diagram illustrating correction of a mask section in a modified embodiment.

In the previous embodiment in FIG. 3, mask section A1 is corrected by correcting the length (extent) of mask section A1. Instead, in the modified embodiment shown in FIG. 5, the reference position Ps may be moved in the closing direction at a low temperature that is lower than a normal temperature and the reference position Ps may be moved in the opening direction at a high temperature that is higher than the normal temperature so that reference position Ps is fixed regardless of the temperature. That is, mask section A1 may be corrected so that reference position Ps is fixed regardless of the temperature to reduce erroneous entrapment detection without changing the length of mask section A1.

In the embodiment, the second temperature sensor TS2, which detects outside temperature, is arranged on the control circuit board CB, which is arranged integrally with the motor body 11. Instead, information of the outside temperature may be obtained from an external device such as a body ECU or a door ECU connected to the control unit 21.

In the embodiment, mask section A1 is corrected in accordance with the outside temperature as well as the inner temperature of the motor body 11. Instead, mask section A1 may be corrected using only the inner temperature of the motor body 11.

In the embodiment, the first temperature sensor TS1, which detects the inner temperature of the motor body 11, is arranged on the brush holder 12*d*. Instead, the first temperature sensor TS1 may be arranged anywhere inside the motor body 11 such as the yoke 12*b* or the gear housing 13*a*.

Further, instead of using sensor detection, the inner temperature may be estimated from driving information, such as driving time, of the motor body 11.

The window glass WG is not limited to glass and may be made of plastic.

The motor body 11 may be a brush motor or a brushless motor (not described in embodiment).

In the embodiment, the opening-closing body controller 10 is applied to a power window device. Instead, the opening-closing body controller 10 may be modified as an opening-closing body controller that drive-controls an open-close body other than the window glass WG in a vehicle (such as sunroof).

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and-or if components in a described system, architecture, device, or circuit are combined differently, and-or replaced or supplemented by other components or their equivalents. The scope of the disclosure is not defined by the detailed description, but by the claims and their equivalents. All variations within the scope of the claims and their equivalents are included in the disclosure.

What is claimed is:

1. An opening-closing body controller comprising:

a motor body that opens and closes an open-close body;

a control unit that controls and drives the motor body, the control unit being configured to perform an entrapment detection process in a section excluding a mask section, the mask section being set from a fully closed position of the open-close body to a preset position in an opening direction of the open-close body; and an inner temperature detector that detects an inner temperature of the motor body, wherein the control unit is configured to:

correct the mask section in accordance with the inner temperature of the motor body detected by the inner temperature detector;

recognize the fully closed position of the open-close body as a reference position, the reference position changing in accordance with ambient temperature; and correct the mask section by setting a corrected reference position, which (i) is shifted from the reference position in a closing direction of the open-close body at a low temperature that is lower than a normal temperature and (ii) is shifted from the reference position in the opening direction at a high temperature that is higher than the normal temperature so that the corrected reference position is located at a constant position regardless of the ambient temperature.

2. The opening-closing body controller according to claim 1, wherein the control unit is configured to correct the mask section in accordance with an outside temperature.

3. The opening-closing body controller according to claim 2, further comprising a control circuit board arranged integrally with the motor body, wherein the control circuit board includes the control unit and a board temperature sensor that detects a temperature around the control circuit board as the outside temperature.

* * * * *